US006826783B1

(12) United States Patent
Grove et al.

(10) Patent No.: US 6,826,783 B1
(45) Date of Patent: Dec. 7, 2004

(54) CHEMICAL/BIOLOGICAL HELMET

(75) Inventors: Corey M. Grove, Red Lion, PA (US); Stephen E. Chase, Jarrettsville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/354,630

(22) Filed: Jan. 30, 2003

(51) Int. Cl.[7] ..... A42B 1/08; A42C 5/04; A62B 19/00

(52) U.S. Cl. ..... 2/424; 2/171.3; 128/201.25

(58) Field of Search ..... 2/422, 410, 436, 2/437, 424, 423, 171.3, 457, 205, 6.1, 6.2, 6.3, 6.4, 6.5, 6.6, 6.7, 906, DIG. 1; 128/201.24, 201.25, 201.23, 201.15, 200.28

(56) References Cited

U.S. PATENT DOCUMENTS

| | | | | | |
|---|---|---|---|---|---|
| 3,172,126 | A | * | 3/1965 | Spano et al. | 2/410 |
| 3,223,086 | A | * | 12/1965 | Denton | 128/201.24 |
| 3,258,010 | A | * | 6/1966 | Austin et al. | 128/201.25 |
| 3,362,403 | A | * | 1/1968 | Fleming et al. | 128/201.24 |
| 3,502,074 | A | * | 3/1970 | Jones et al. | 128/202.11 |
| 4,186,736 | A | * | 2/1980 | Angioletti et al. | 128/201.19 |
| 4,227,520 | A | * | 10/1980 | Lord | 128/201.24 |
| 4,280,491 | A | * | 7/1981 | Berg et al. | 128/201.24 |
| 4,350,507 | A | * | 9/1982 | Greenough et al. | 73/863.23 |
| 4,462,399 | A | * | 7/1984 | Braun | 128/201.25 |
| 4,475,248 | A | * | 10/1984 | L'Abbe et al. | 2/2.5 |
| 4,730,612 | A | * | 3/1988 | Dampney | 128/201.24 |
| 4,847,914 | A | * | 7/1989 | Suda | 2/457 |
| 5,104,430 | A | * | 4/1992 | Her-Mou | 55/385.1 |
| 5,283,914 | A | * | 2/1994 | James | 2/424 |
| 5,515,843 | A | * | 5/1996 | Chang | 128/201.25 |
| 5,533,500 | A | * | 7/1996 | Her-Mou | 128/201.25 |
| 5,787,513 | A | * | 8/1998 | Sharmat et al. | 2/411 |
| 6,233,748 | B1 | * | 5/2001 | Gieger et al. | 2/410 |
| 6,438,763 | B2 | * | 8/2002 | Guay et al. | 2/424 |
| 6,442,767 | B1 | * | 9/2002 | Meckes et al. | 2/424 |
| 6,606,751 | B1 | * | 8/2003 | Kalhok et al. | 2/424 |
| 2003/0066121 | A1 | * | 4/2003 | Diaz et al. | 2/171.3 |

FOREIGN PATENT DOCUMENTS

| | | | | | |
|---|---|---|---|---|---|
| EP | 371858 | A1 | * | 6/1990 | A42B/3/10 |
| GB | 2061696 | A | * | 5/1981 | A42B/3/00 |
| GB | 2182568 | A | * | 5/1987 | A62B/18/00 |
| JP | 05085446 | A | * | 4/1993 | B62J/39/00 |

* cited by examiner

*Primary Examiner*—Rodney M. Lindsey
(74) *Attorney, Agent, or Firm*—Ulysses John Biffoni

(57) ABSTRACT

A chemical/biological protection helmet is provided with a filter system. In order to provide for improved balance control and visibility, the filter system is positioned in the rear of the helmet. By rotating the visors, provided in the front of the helmet, the filter system can be actuated as the helmet is sealed.

16 Claims, 3 Drawing Sheets

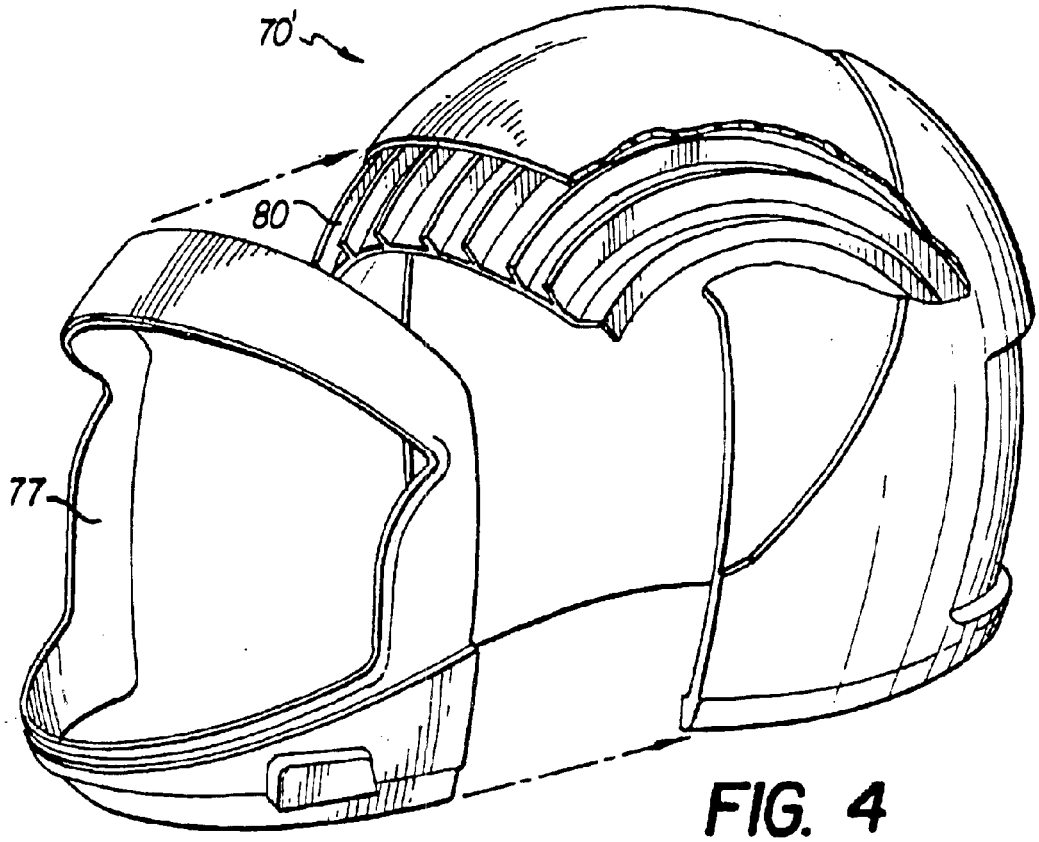
FIG. 4
FIG. 5
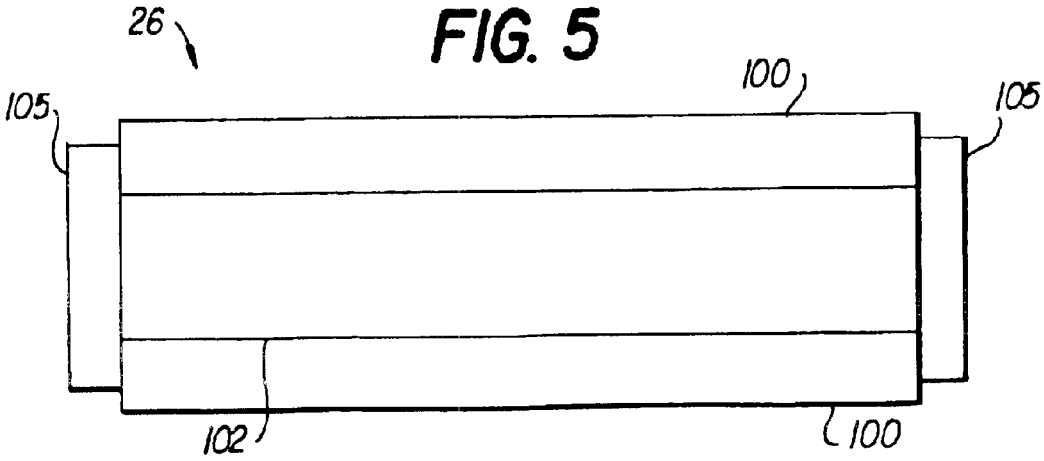

CHEMICAL/BIOLOGICAL HELMET

BACKGROUND OF THE INVENTION

1. Field of the Invention

The present invention relates to the field of personal safety devices including the ability to provide protection in hostile environments. Specifically, the helmet of the invention includes a selectively actuated filter system, wherein the weight or bulk of the system is located at the rear of the wearer's head.

2. Background

Since the advent of chemical and biological weapons during the early part of the twentieth century, various safety devices have been developed to ensure the protection of a user by filtering out harmful materials from the ambient air before being inhaled by the user. These safety devices generally include a mask to be worn over the face of the user and a complex system of hoses, tubes and filters. When protection is necessary, the user dons the device, often including multiple involved steps, learned through extended training.

More recently, such conventional protection devices have been combined with helmets and other impact protection devices. For example, U.S. Pat. No. 5,245,993 and No. 4,266,301, both of which are herein incorporated by reference in their entireties, disclose combinations of helmets with these conventional gas masks.

While newer devices have integrated the filtering systems into the helmets, thus eliminating the need for complex hoses, the often bulky or heavy filtering systems are generally positioned in locations generating unnatural forces affecting the center of gravity and forcing the user to compensate. For example, the filtering system of U.S. Pat. No. 5,533,500, herein incorporated by reference in its entirety, extends from the front of the helmet to the uppermost section, but such a placement nevertheless does not offset the awkward center of gravity.

SUMMARY OF THE INVENTION

In order to mitigate problems related to center of gravity and comfort of a user, the filtering system of the chemical/biological helmet of the invention has been moved to the back section of the helmet. Thus, the weight associated with the filter and/or blower are placed farther to the rear of the helmet, such that the center of gravity is positioned over the shoulders of the user, instead of in front of the user's body. By integrating the filter into the structure of the helmet, the need for a body mounted filter and bulky hoses, as in many conventional systems, is eliminated.

Because much of the facial bulk is removed, the included lens or visor system can be expanded to improve visual field of view. Since the mask and hood are not under the helmet, helmet comfort and sealing of optional ear cups are not degraded. Additionally, helmet displays can be head mounted and worn under the helmet visor for improved protection, compatibility and stability.

The helmet of the invention is modular. In other words, it can be worn with or without chemical/biological protection. The visor can be rotated down to rapidly seal off the interior of the helmet from the environment, and optionally automatically activate any blowers associated with the filters. Chemical/biological filters are embedded into the back of the helmet system, and exhaled air is passed though vents in the front of the helmet. The helmet may additionally contain a neck collar and seal for protection of the face and eyes of the wearer.

The helmet of the invention may also contain other components. For example, optional helmet devices include a nosecup assembly, a communications assembly, impact liners, a suspension assembly and a helmet stabilization device. Additionally, the helmet may include a positive pressure or circulating filter blower system, a heads-up display system (for example, internal to the visor), spectacles, radio, and embedded or modular sensor devices such as image intensifiers.

BRIEF DESCRIPTION OF THE DRAWINGS

FIG. 4 is a view of a second embodiment of the invention.

FIG. 5 is a view of a filter cross-section.

DETAILED DESCRIPTION OF THE INVENTION

Figure 1:
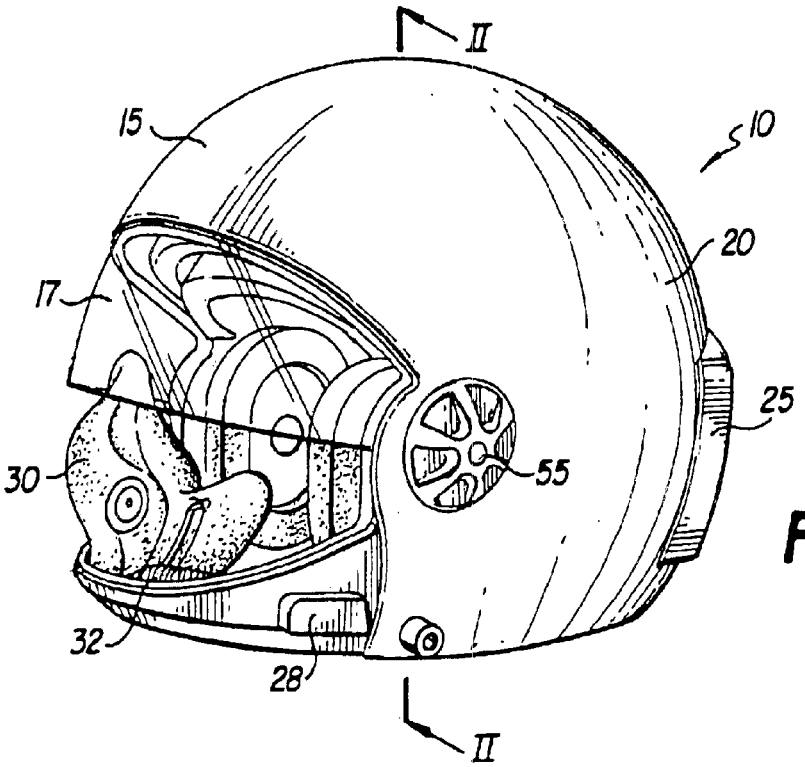
FIG. 1 shows the helmet of the invention.

FIG. 1 shows a helmet 10 of the invention. Specifically, helmet 10 has a front section 15, including a visor 17, and a rear section 20. Disposed in rear section 20 is a filter system 25. Filter system 25 typically includes a filter 26 and an optional blower mechanism 27. Ambient air is drawn into filter 26 via blower mechanism 27, if provided, or simply by forces generated by the breathing of a user, where harmful particulates or other materials are removed and clean air is finally passed into the interior of helmet 10. Exhaled air is forced out of one or more exhalation vents 28, preferably disposed on the lower area of lower section 15. Preferably, exhalation vents 28 are equipped with one-way valves to prevent the influx of potentially harmful ambient air.

Figure 2:
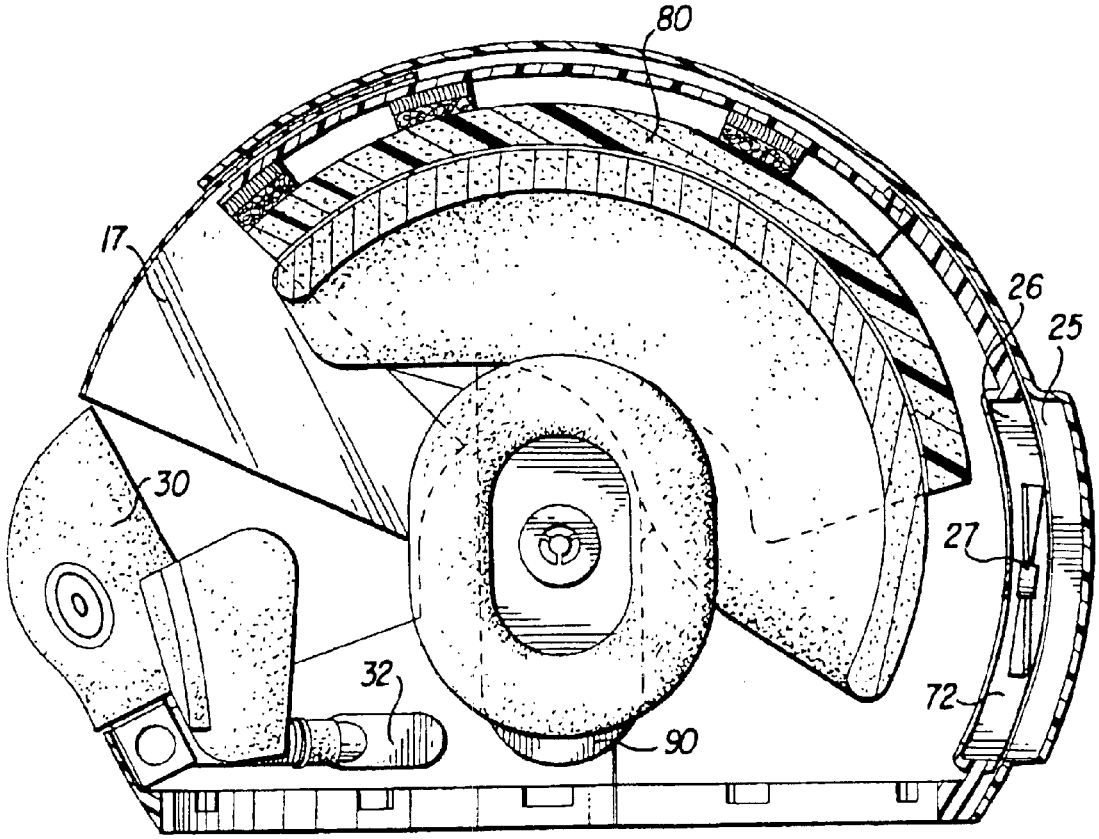
FIG. 2 is a cross section of the helmet from front to back along a longitudinal axis of the helmet along the center of FIG. 1.

FIG. 1 in combination with FIG. 2 depicts an optional nosecup assembly 30 connected to exhalation vents 28 via hoses 32. Nosecup assembly 30 may be provided in helmet 10 to control and channel exhaled air within helmet 10. Although preferably, nosecup assembly 30 is mounted to the interior of helmet 10, it may alternatively be affixed to a headsock, to be donned prior to donning helmet 10. Nosecup assembly 30 keeps moist air from reaching visor 17, while directing exhaled carbon dioxide to exhalation vents 28. Typically, nosecup assembly 30 and hoses 32 are constructed of a polymer, such as a silicone elastomer.

Figure 3:
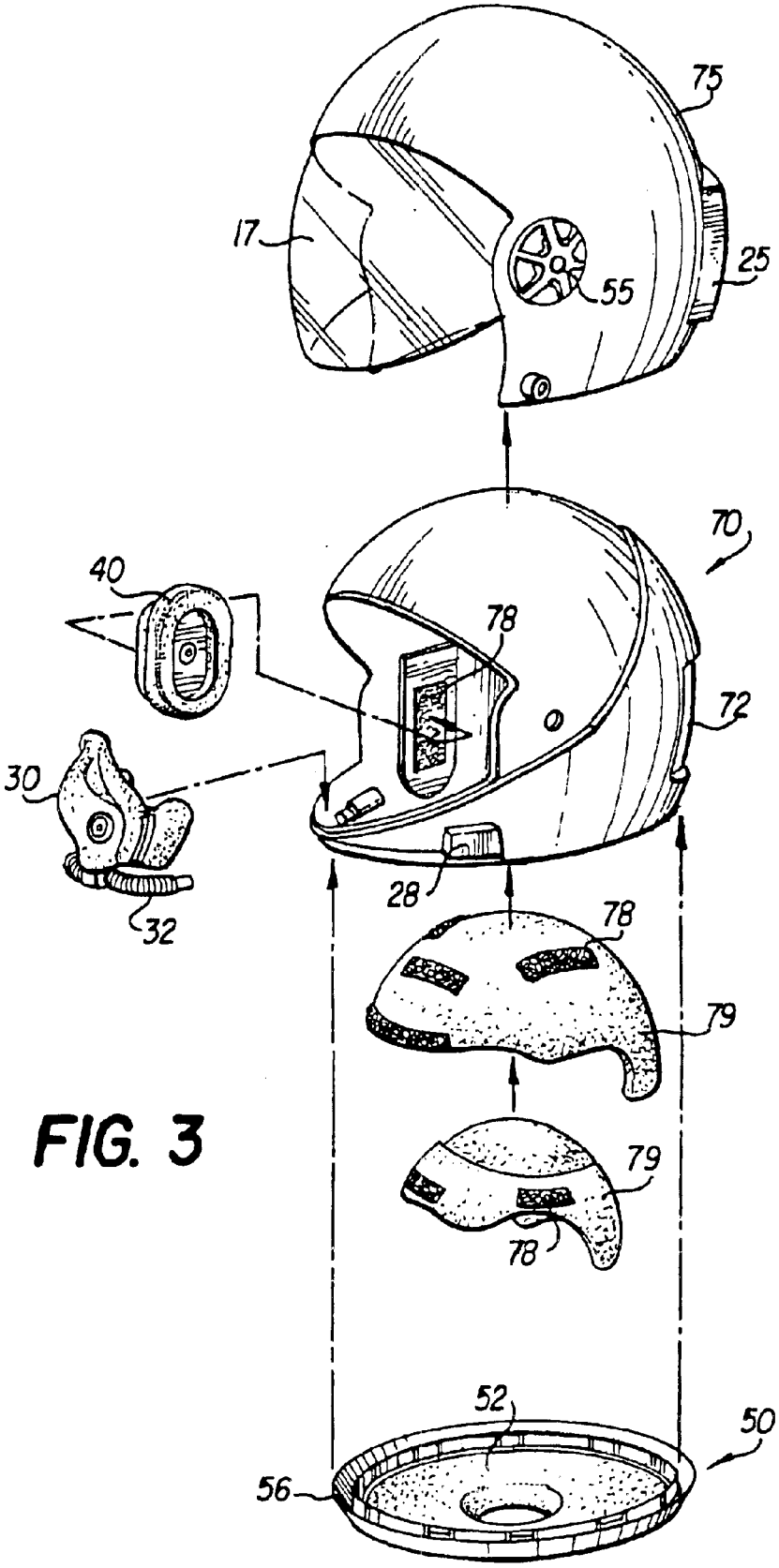
FIG. 3 is an exploded view of the helmet.

FIG. 3 is an exploded view of helmet 10 in a preferred embodiment. Shown below a main structure of helmet 10 is a neck collar 50, including a neck seal 52 and an outer rim 56. Neck collar 50 allows for protection of the face and eyes of a user from chemical/biological hazards. Neck collar 50 is typically sized to fit the user and is designed to reduce the contamination level in the face and eye area of the helmet. To aid in donning, neck collar 50 preferably is donned before the rest of helmet 10. Once helmet 10 is donned, neck collar 50 is clamped or otherwise sealingly fitted to helmet 10. While outer rim 56 corresponds essentially in size, shape and construction to helmet 10, neck seal 52 preferably ranges in thickness from about 0.010 inches to about 0.030 inches, depending upon the location on the seal and the selected material. The seal, typically, is made of high strength silicone rubber, but could be formed from any organic rubber with suitable elongation and modulus properties, e.g., elongation of at least 500%.

It is additionally considered within the scope of the invention to provide a face seal. This option provides an improved unblown protection. Such a face seal option can be used alone or in combination with neck collar 50.

A combination of an inner shell 70 and outer shell 75 are used to construct helmet 10. In the rear of inner shell 70 is a filter receiving aperture 72, into which filter system 25 is positioned. In one embodiment, outer shell 75 is constructed to be worn alone as a single piece, but is preferably constructed to be mated with inner shell 70. Thus, it is possible to utilize outer shell 75 without inner shell 70, albeit without the biological/chemical protection provided when inner shell 70, is mated with outer shell 75. Thus, the combination of inner shell 70 and outer shell 75, provides a platform for the other optional headgear, while simultaneously providing chemical/biological protection.

Typically, outer shell 75 houses visor 17, which is rotateable from a first position to a second position by rotating knobs 55. In the first position, visor 17 is stored between outer shell 75 and inner shell 70, such that helmet 10 is unsealed and the interior is exposed to the environment. In order to seal the contents of helmet 10, visor 17 is simply moved from the first position to the second position, in which the helmet 10 is sealed optionally by a clamping mechanism or an inflatable seal. In one embodiment, when visor 17 is rotated in the second position, blower mechanism 27 is activated (energized). This can be achieved by, for example, having a switch actuated by the physical rotation of visor 17 or knobs 55, or via a manually actuated switch. Typically, visor 17 is made from a transparent polymer having suitable optical properties, preferably polycarbonate or polyurethane material.

Outer shell 75 can also provide impact protection due to its construction. For example, outer shell 75, as shown in FIG. 4, may be formed from an impact resistant material, such as a spectra/graphite composite. While inner shell 70 may be constructed of the same material to further provide impact protection, inner shell 70 may also be made of a lower impact plastic to simplify fabrication and assembly. In order to fit wearers of varying sizes, inner shells 70 of different size may be constructed and designed to be mated with the same universally sized outer shells 75, in a modular fashion.

In one embodiment, visor 17 is permanently sealed as part of inner shell 70 to prohibit unsealing, i.e., visor 17 is fixed in the downward position shown in FIG. 3. However, the rotating option provides for rapid transition to the chemical/biological mode that can be performed during operations. Having the ability to rapidly seal off to a chemical/biological protection mode allows a user to be less encumbered prior to entering such an environment. By providing visor 17 with the ability to rotate into an inactive position, the user is freed from carrying a separate device to be assembled and worn only when required.

By storing the visor 17 between inner shell 70 and outer shell 75, visor 17 is protected from the environment when not in use. This is particularly advantageous when visor 17 actually includes multiple elements, each of which is capable of sealing helmet 17 independently. Each of the elements provides an additional layer of protection, to be used alone or in combination. For example, one element may provide sun light protection, while another protects against lasers. Finally, one or more elements of visor 17 may be incorporated into a heads-up display system, wherein icons or other information are displayed to the user.

Blower mechanism 27, shown schematically in FIG. 2, may be used to provide positive pressure within helmet 10. Optionally, such blowers 27 can be placed either in the rear section, in proximity to the filter assembly 25 to provide a "push through" filter system, or in the upper portion of visor 17 to provide a "pull through" filter system. Other electronic systems, such as spectacles, microphones, speakers and other communication devices such as radios, and heads-up displays, mounted either inside inner shell 70; and sensors, such as image intensifiers or infrared cameras can also be added to outer shell 75. By mounting displays under visor 17, a significant benefit can be realized over existing systems, because they can be made smaller and be better protected from a hostile environment.

In another embodiment, inner shell 70' can be made to split, as shown in FIG. 4. This split can optionally be located at any location along helmet 10 to provide additional room when donning and could allow the helmet to flex, which is useful when donning while wearing communications headsets.

FIG. 4 additionally shows a multi-functional helmet liner 80 incorporated into inner shell 70' to allow air to circulate from filter system 25 in rear section 20 of helmet 10. It must also be noted that outer shell 75' may also be equipped with the same inner liner 80. Liner 80 provides ducting necessary to direct filtered air over visor 17 to prevent fogging. Such ducts can be molded directly into liner 80 and channel ribs can be tailored for helmet impact protection based on the number of ribs, height and liner material. Typically, liner 80 is constructed of a lightweight material, such as polyethylene. However, the density may be varied to enhance material stiffness and impact properties. Alternatively, a standard foam liner can be modified with spacers to facilitate circulation within helmet 10.

Additionally, helmet 10 may be provided with cushioning means 79, such as foam padding, molded plastic structures, or simple pieces of fabric, designed to either comfort the user or to reduce forces from impacts. FIG. 3 depicts a preferred embodiment, wherein two cushioning means (i.e., foam padding) are affixed to the interior surface of inner shell 70 with permanent or removable affixing means 78, such as hook-and-pile fasteners (i.e., VELCRO hook-and-loop fasteners), double sided tape, glue, or screws. Such affixing means 78 may additionally be used to secure nosecup assembly 30 and earcup 40.

Helmet 10 may be provided with one or more adjustment devices. For example, tabs 90 (FIG. 2) may be attached to the inside of inner shell 70 to allow attachment of, for example, a chin strap, to secure helmet 10. Tabs 90 may also be used to tighten ear cups 40 to further aid in helmet stabilization.

Finally, filter assembly 25 is particularly designed to clean any harmful materials from the environment. Filter 26 is also preferably designed to provide low breathing resistances and is also preferably formed from more than one filter medium. The filter media are typically carbon loaded web media 102 (FIG. 5) for vapor filtration and particulate media 100, for example, electrostatic media for particulate filtration.

In a preferred embodiment, sorbent layers are made from carbon loaded web. Carbon loading can be accomplished using ground ASZM-TEDA carbon from Calgon Carbon Corporation of Pittsburgh, Pa. This media offers excellent sorbent filtration and low pressure drop characteristics. The media are typically loaded to 300 $g/m^2$ of carbon and layered to provide the required chemical protection for any operation. Use of four layers is preferred, wherein the typical surface area for the entire filter 26 is approximately 250 $cm^2$ to 300 $cm^2$.

The particulate layers are preferably made from an electrostatic media, for example. Particulate filtration media are included along with the carbon loaded web structure. Preferred is a material that offers excellent aerosol filtration and very low pressure drop characteristics. Typically, the media are optimized to provide near HEPA (high efficiency particulate air) performance at a depth of approximately 0.1 inches, wherein the surface area is 250 $cm^2$ to 300 $cm^2$. Such HEPA performance is generally understood to mean retention of all particles as small as 0.3 microns (the typical size of airborne particles such as pollen, dust, mold spores, dust mites, bacteria, and animal or bird dander) with an efficiency rating of 99.97%.

Filter 26 is preferably formed by layering the sorbent structure (e.g., carbon leaded web media 102) between two layers of particulate media 102. Edge sealing (by edge seal 105) can be accomplished either with a thermoplastic edge seal adhesive or a silicone adhesive, as shown in FIG. 5.

It should be apparent that embodiments other than those specifically described above may come within the spirit and scope of the present invention. Hence, the present invention is not limited by the above description, but rather is defined by the claims appended hereto.

We claim:

1. A modular helmet, comprising:

(a) an outer shell including a visor, said outer shell adapted to function as a standard helmet to protect the head of a wearer; and (b) an inner shell which can be removably attached to said outer shell, said inner shell comprising a front section and a back section, said back section including a chemical-biological filtration system comprising a chemical-biological filter positioned such that the center-of-gravity of the helmet is positioned over the shoulders of the wearer when the inner shell is attached, and said inner shell further comprising a liner having ducts positioned to direct airflow drawn through said filtration system over said visor, wherein said inner shell can be attached to said outer shell when needed to provide a helmet having chemical-biological protection capability.

2. The helmet of claim 1, wherein said inner shell further comprises a nose cup assembly and exhaust ports connected to said nose cup assembly.

3. The helmet of claim 2, wherein said nose cup assembly comprises a nose cup and at least one exhaust hose, wherein said exhaust hose connects said nose cup to said exhaust ports.

4. The helmet of claim 1, wherein said liner is formed from polyethylene or foam and modified with spacers to provide circulation channels.

5. The helmet of claim 1, wherein said inner shell further comprises a first part and a second part, such that during donning of said helmet, said first part and said second part are mated to form said inner shell.

6. The helmet of claim 1, further comprising a neck collar, said neck collar comprising a neck seal formed from rubber, and an outer rim attached to said neck seal, said neck collar being attached or otherwise fitted to said inner shell or said outer shell of said helmet such that an airtight seal is created around the neck of a person donning said helmet.

7. The helmet of claim 1, further comprising at least one adjustment device to secure said helmet to a wearer, said adjustment device consisting of and ear cups.

8. The helmet of claim 1, wherein said filtration system is positioned in a recess in said back section of said inner shell.

9. The helmet of claim 1, wherein said chemical-biological filtration system further comprises and at least one blower positioned to draw external ambient air through said filter and into the interior of said helmet.

10. The helmet of claim 9, wherein said filter comprises carbon-loaded web media and electrostatic media.

11. The helmet of claim 10, wherein said carbon loaded web media comprises at least one layer impregnated with carbon, loaded to at least 300 grams of carbon per square meter of media.

12. The helmet of claim 10, wherein said carbon loaded web media is sandwiched between sections of electrostatic particle media and edge sealed with an adhesive sealant.

13. The helmet of claim 9, wherein said filter has a total surface area of between about 200 and 350 square centimeters.

14. The helmet of claim 1, wherein said visor seals the interior of said helmet from the environment.

15. The helmet of claim 1, wherein said visor is pivotable from a closed position wherein the interior of said helmet is sealed from the environment, to an open position wherein the interior of said helmet is open to the environment.

16. The helmet of claim 15, wherein when in said open position said visor is stored between said outer shell and said inner shell.

* * * * *